US006199539B1

(12) United States Patent
Pearlman et al.

(10) Patent No.: US 6,199,539 B1
(45) Date of Patent: Mar. 13, 2001

(54) ANTI-ROTATION MECHANISM FOR A HIGH PRESSURE FUEL SUPPLY PIPE IN A COMMON RAIL FUEL SYSTEM

(75) Inventors: Samuel Pearlman, West Bloomfield; James Edward McCarthy, Jr.; David Henry Mitchell, both of Canton; Ronald Michael Tkac, Brighton, all of MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/609,006

(22) Filed: Jun. 22, 2000

(51) Int. Cl.[7] ..... F02M 55/02
(52) U.S. Cl. ..... 123/470; 123/469
(58) Field of Search ..... 123/468, 469, 123/470, 472, 456

(56) References Cited

U.S. PATENT DOCUMENTS

| | | | | |
|---|---|---|---|---|
| 3,845,748 | * | 11/1974 | Eisenberg | 123/470 |
| 4,485,790 | * | 12/1984 | Nishimura et al. | 123/468 |
| 5,365,907 | * | 11/1994 | Dietrich et al. | 123/470 |
| 5,617,828 | * | 4/1997 | Kuegel et al. | 123/468 |
| 5,692,477 | * | 12/1997 | Berger et al. | 123/468 |
| 5,775,303 | * | 7/1998 | Sweetland et al. | 123/470 |

* cited by examiner

*Primary Examiner*—Thomas N. Moulis
(74) *Attorney, Agent, or Firm*—Bill C. Panagos

(57) ABSTRACT

A circular cross-sectional fuel pipe can be prevented from undesired rotation in an engine cylinder head, by a key-key slot combination having a relatively small radial dimension. The key slot is formed by a groove formed in a cylindrical sleeve that is press fit in a counterbore machined in the cylinder head. The mating key can be a ball, or pin, or bar press fit into a side surface of the fuel pipe.

5 Claims, 2 Drawing Sheets

ANTI-ROTATION MECHANISM FOR A HIGH PRESSURE FUEL SUPPLY PIPE IN A COMMON RAIL FUEL SYSTEM

BACKGROUND AND SUMMARY OF THE INVENTION

This invention relates to diesel engines, and more particularly to high-pressure fuel supply pipes for diesel engine fuel injectors in a common rail fuel system.

In one class of diesel engines with common rail fuel systems, fuel is supplied to the engine fuel injectors through fuel pipes extending within the cylinder head. Each fuel pipe has a frusto-conical end surface in pressure engagement with a mating recess in a side surface of the fuel injector, to establish a sealed connection between the fuel pipe and the side surface of the fuel injector.

A nut is threaded into the cylinder head to exert an axial force on the fuel pipe, whereby the fuel pipe end surface is pressured against a recessed side surface of the fuel injector. During initial movement of the nut the frictional engagement between the nut and the fuel pipe tends to rotate the fuel pipe around the pipe longitudinal axis. Such pipe rotation tends to disturb the surface contact between the pipe end surface and the recessed area of the fuel injector so as to potentially produce fuel leakage at the pipe end surface. Therefore, it is necessary to provide some mechanism for preventing the fuel pipe from rotating while the nut is being turned to apply an axial force on the fuel pipe.

The present invention relates to a key-slot relationship for preventing rotation of the fuel supply pipe in the cylinder head. In the preferred practice of the invention, the key slot is formed in a sleeve that is press fit in a bore in the cylinder head. The sleeve has a relatively precise well thickness so that the slot has a relatively close dimension radial relationship to the key. The key can take various forms, e.g., a bar having a half moon profile, or a ball, or a cylindrical pin. The invention relates more particularly to a slotted sleeve for forming the key slot.

In a prior art arrangement the key slot was provided by a groove formed directly in a bored hole in the cylinder head. The groove had a semi-circular cross section. The key was a ball having a press fit in a socket in a side surface of the fuel pipe. However, it was determined that the circumferential load forces on the key tended to degrade the slot surfaces at the mouth of the slot, so that the ball-shaped key tended to exert a radial cam force on the slot surface. In some instances the ball-shaped key imposed a radial load on the fuel pipe, whereby the fuel pipe experienced an undesired local radial distortion.

The undesired radial distortion of the fuel pipe results from a tolerance build up on the various machined surfaces. There is a first tolerance inaccuracy on the diameter of the bore that slidably supports the fuel pipe. There is a second tolerance inaccuracy in the semi-circular cross section groove that forms the key slot. This second inaccuracy is particularly troublesome, in that it can -produce an undesired looseness of the ball-shaped key in the key slot or an undesired frictional resistance between the key and the key slot surfaces.

The use of a slotted sleeve as the mechanism for forming the key slot, is advantageous in that the sleeve wall thickness automatically provides the radial dimension of the key slot, so that inaccuracies or inconsistencies of the slot machining process do not adversely affect the radial dimension of the key slot.

The present invention relates to the employment of a sleeve insert in an engine cylinder head for providing a key slot that prevents rotation of a fuel pipe in the cylinder head. Specific features of the invention will be apparent from the attached drawings and description of an illustrative embodiment of the invention.

DESCRIPTION OF A PREFERRED EMBODIMENT OF THE INVENTION

Figure 1:
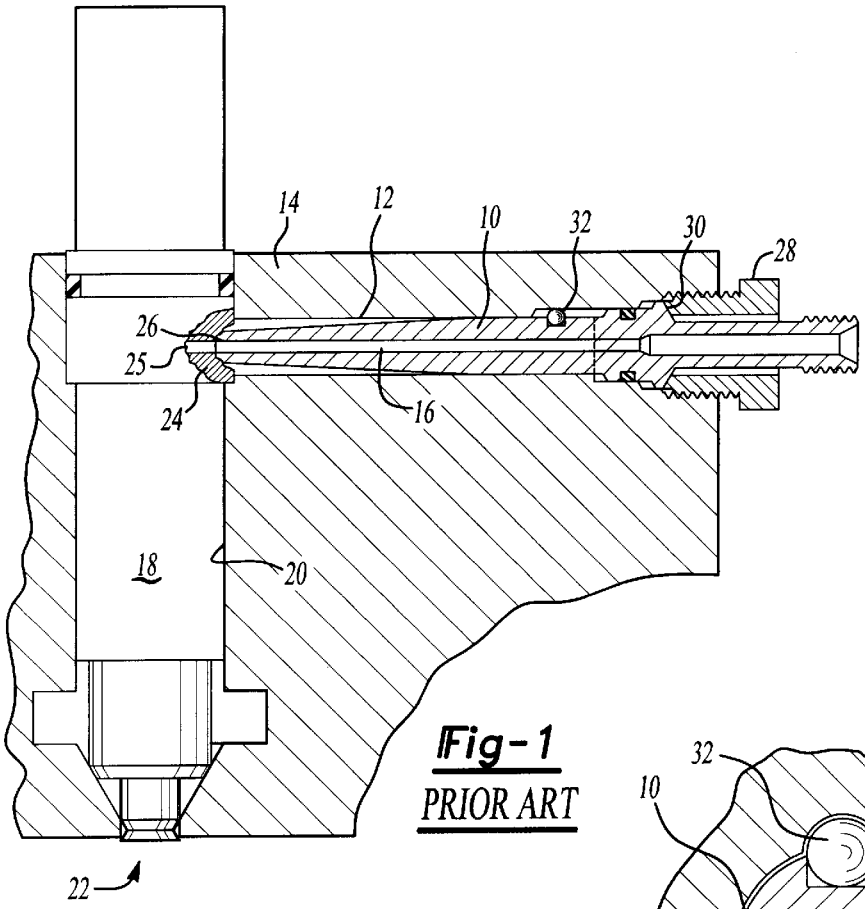
Fig-1 PRIOR ART
FIG. 1 is a fragmentary sectional view taken through a cylinder head that mounts a fuel injector and fuel supply pipe arranged according to prior art practice.
Figure 3:
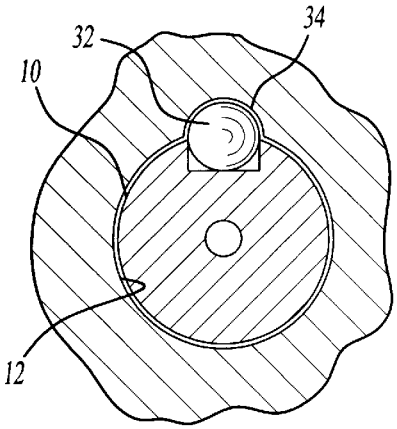
FIG. 3 is a transverse cross sectional view taken on line 3—3 in FIG. 1.
Figure 2:
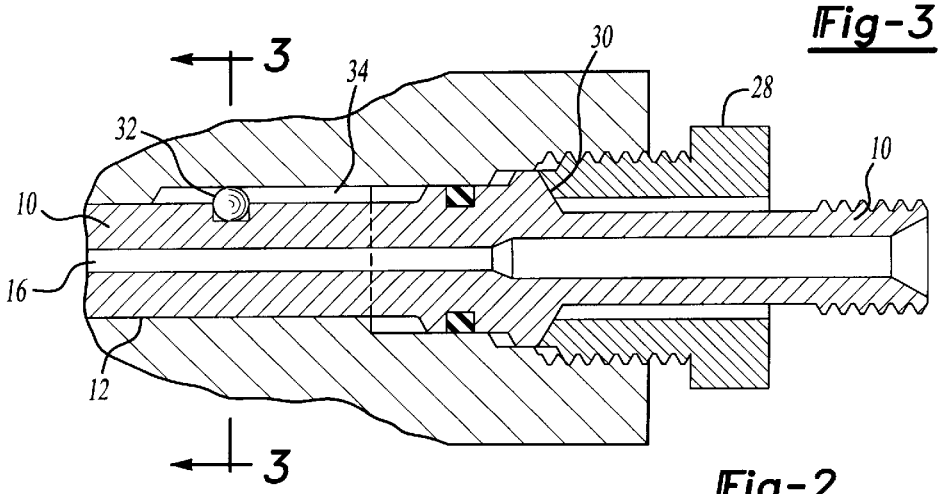
FIG. 2 is a fragmentary enlarged view taken in the same direction as FIG. 1, but showing features not apparent in FIG. 1.

Referring to the drawings, FIGS. 1 through 3 show a fuel pipe mounting arrangement according to the prior art. As shown, a fuel pipe 10 is removably disposed in a bore 12 formed in engine cylinder head 14. The fuel pipe has a fuel passage 16 for supplying pressurized fuel to a fuel injector 18. It is understood that a high pressure common rail fuel system is being described, but that the invention may have application in any fuel system.

Fuel injector 18 is a conventional unitary device insertable into a bore 20 in the cylinder head for delivering a pressurized fuel spray to a combustion chamber, indicated generally by numeral 22. The fuel injector can be a commercially available unit supplied by the Robert Bosch Co., of Chicago Ill., or Diesel Technology Company of Grand Rapids, Mich.

Fuel pipe 10 has a frusto-conical end 24 adapted to seat in a mating recess in the side surface of fuel injector 18, whereby pressurized fuel, e.g., diesel fuel, can be delivered through passage 16 to a passage 25 in the injector, without leakage of fuel at the joint between the end of pipe 10 and the mating recess 26. To insure a fluid-tight joint between pipe end 24 and frusto-conical recess 26, the fuel pipe is subjected to an axial installation force by a nut 28. The nut is threaded into a counterbore in the cylinder head, so that an end surface on the nut applies an axial force to an annular shoulder 30 on the fuel pipe.

During the pipe installation process, nut 28 is rotated by a suitable wrench, to apply an axial force to shoulder 30 of the fuel pipe. The frictional engagement force between the nut and shoulder 30 tends to rotate fuel pipe 10 in bore 12. Such rotation is undesirable, in that it tends to produce a pressurized frictional contact between pipe end 24 and the surface of recess 26; pipe end 24 frictionally abraids the surface of recess 26 so as to from minute grooves or ruts in the recess surface. When pressurized fuel is supplied to passage 16 there is a possibility of fuel leakage at the joint between pipe end 24 and recess 26.

To prevent fuel leakage at pipe end 24, the fuel pipe is provided with an anti-rotation mechanism. The anti-rotation mechanism prevents pipe 10 from rotating while nut 28 is being turned to apply an axial force to the pipe. As shown in FIGS. 2 and 3, the anti-rotation mechanism includes a ball-shaped key 32 carried by the fuel pipe, and an axial slot (or groove) 34 machined into the surface of bore 12 in the cylinder head. The ball-shaped key 32 can be press-fit into a socket in the side surface of pipe 10, whereby the key becomes an integral part of the fuel pipe. Slot 34 can have a semi-circular cross section conforming to the surface contour of ball 32, as shown in FIG. 3.

One problem with the arrangement depicted in FIGS. 1, 2 and 3, is that machining tolerances on bore 12 and slot (groove) 34 can cause the slot to have an indeterminate fit on ball 32, i.e., overly loose or overly tight. The ball typically has a diameter of about three eighth inch, so that groove 34 has a depth somewhat less than three sixteenth inch; the ball-groove dimensions are limited by the thread diameter on nut 28. The relatively small groove depth can cause machining tolerances on the groove to produce measurable differences in the fit of slot 34 on ball 32. In some instances a loose-fitting ball 32 degraded the edges at the mouth of slot 34, so that the ball has become embedded in the groove surface. An overly tight fit of the ball in groove 34 can interfere with full axial motion of the fuel pipe.

Figure 4:
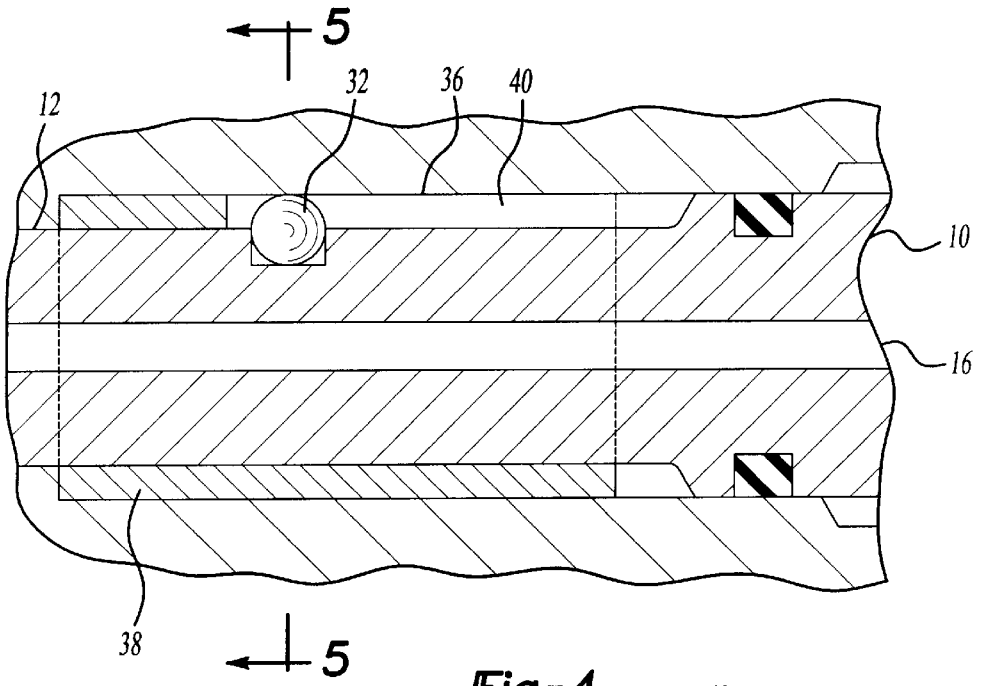
FIG. 4 is a fragmentary sectional view taken in the same direction as FIG. 2, but showing a construction according to the present invention.
Figure 5:
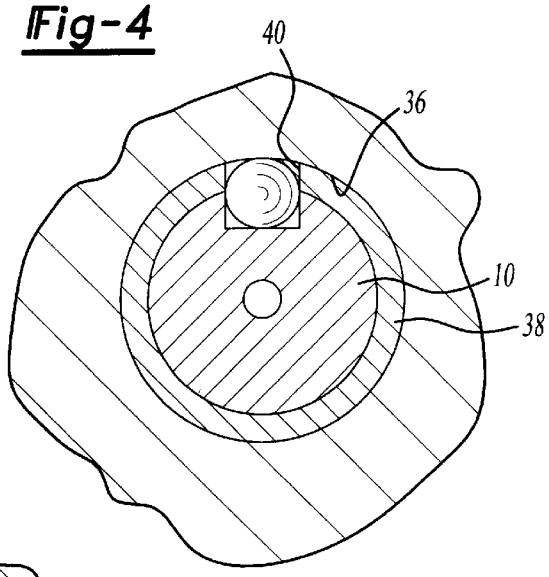
FIG. 5 is a transverse sectional view taken on line 5—5 in FIG. 4.

Undesired embedding of ball 32 in the cast iron cylinder head 14 can be detrimental, as regards premature limiting of the nut 28 rotation, or localized radial collapse of the fuel pipe wall. The present invention proposes an alternate key-key slot arrangement, designed to eliminate problems associated with the prior art arrangement depicted in FIGS. 1 through 3. FIGS. 4 and 5 show one form that the invention can take.

Referring to FIG. 4, bore 12 has an enlarged section 36 that supports a sleeve 38. The sleeve in turn provides a bearing surface for the axially slidable fuel supply pipe 10. Pipe 10 can be the same construction that is depicted in FIGS. 1 through 3. The non-illustrated rightmost end portion of pipe 10 has a shoulder similar to aforementioned shoulder 30, such that the pipe can be biased axially by means of a nut (similar to nut 28).

A side surface of fuel supply pipe 10 has a socket that supports a ball-shaped key 32; the socket depth is such that slightly less than one half the ball diameter projects from the pipe side surface into an axial slot 40 machined into sleeve 38. After slot 40 has been formed in the sleeve, the sleeve is press-fit into section 36 of bore 12, so that the sleeve becomes a fixed part of the cylinder head 14. Slot 40 performs the key-slot function of slot 34 in the FIG. 2 arrangement.

In the FIG. 4 arrangement the radial depth of slot 40 is controlled by the wall thickness of sleeve 38. That wall thickness can be held to close tolerances by appropriate sleeve selection and/or by machining procedures carried out prior to insertion of the sleeve into enlarged section 36 of bore 12. Such machining operations can more easily be controlled than the machining operations needed to from slot 34 directly in the cylinder head. The process of measuring and machining a groove 34 directly in the cylinder head is not easily carried out because there is no flat reference surface for easily ascertaining the depth of the groove.

The use of a slotted sleeve to form a key slot may also be advantageous in that the sleeve material can be selected to provide a desired hardness and wear resistance, compatible with the material used for ball 32. The materials for ball 32 and sleeve 38 can be selected on the basis of mutual compatibility, i.e., wear and toughness.

Figure 6:
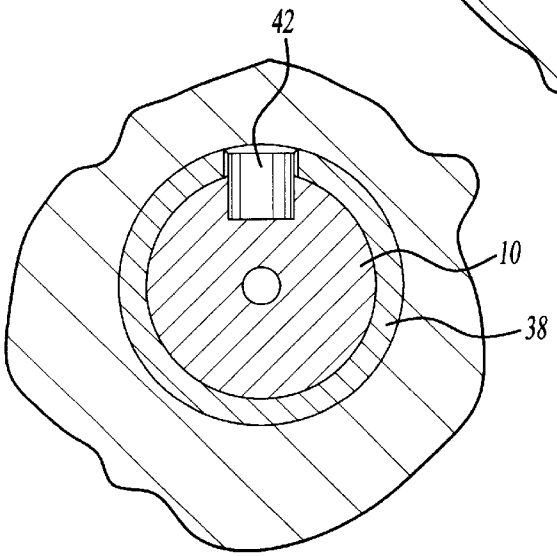
FIG. 6 is a sectional view taken in the same direction as FIG. 5, but showing another embodiment of the invention.

The key can take configurations other than spherical. FIG. 6 shows a key 42 formed as a cylindrical pin. Such a pin would be press fit into a cylindrical socket in the side surface of fuel supply pipe 10. Other configurations can be used for the key, e.g., a narrow rectangular bar press fit into a mating slot machined into a side surface of the fuel pipe.

The invention is particularly concerned with the employment of a slotted sleeve press fit into a cylindrical bore section 36 to provide a key slot for preventing rotation of the associated fuel pipe in a high pressure, common rail fuel system. The cooperating key can take various configurations, e.g., a spherical ball shape, or a cylindrical pin configuration, or an elongated bar configuration press fit into a side surface of the high pressure fuel pipe.

What is claimed:

1. In combination an engine cylinder head, a fuel injector extending through said cylinder head, and a fuel supply means located within the cylinder head for supplying pressurized fuel to said injector; said fuel supply means comprising a high pressure fuel pipe, and means preventing rotary movement of said fuel pipe; said rotation-prevention means comprising a sleeve press-fit into said cylinder head, and a key carried by said fuel pipe; said sleeve heaving an axial slot therein, said key extending from said fuel pipe into said slot to prevent rotation of said pipe within said sleeve.

2. The combination of claim 1, wherein said fuel pipe has a said surface, and a socket in said side surface; said key having a press fit in said socket.

3. The combination of claim 2, wherein said key comprises a ball press fit into said socket.

4. The combination of claim 2, wherein said key comprises a cylindrical pin press fit into said socket.

5. The combination of claim 1, wherein said fuel supply means is a common rail fuel system.

* * * * *